United States Patent [19]

Chen et al.

[11] 4,452,640

[45] Jun. 5, 1984

[54] QUANTITATIVE HYDROLYSIS OF CELLULOSE TO GLUCOSE USING ZINC CHLORIDE

[75] Inventors: Li Fu Chen, West Lafayette, Ind.; Che-Ming Yang, Clark, N.J.

[73] Assignee: Purdue Research Foundation, West Lafayette, Ind.

[21] Appl. No.: 377,077

[22] Filed: May 11, 1982

[51] Int. Cl.[3] ..... C13K 1/02

[52] U.S. Cl. ..... 127/37; 435/105

[58] Field of Search ..... 127/37; 435/99, 105

[56] References Cited

U.S. PATENT DOCUMENTS 3,479,248 11/1969 Nobile ..... 127/37 X
4,018,620 4/1977 Penque ..... 127/37
4,237,226 12/1980 Grethlein ..... 435/99
4,304,649 12/1981 Han ..... 127/37 X

FOREIGN PATENT DOCUMENTS 44622 1/1982 European Pat. Off. ..... 127/37
57-22695 2/1982 Japan ..... 435/99

OTHER PUBLICATIONS

Chem. Abstracts, 98:91246 X; Chen and Gong; 1982.

*Primary Examiner*—Kenneth M. Schor
*Attorney, Agent, or Firm*—Cushman, Darby & Cushman

[57] ABSTRACT

Cellulose may be quantitatively hydrolyzed to glucose without formation of degradation products by pretreatment of cellulose with zinc chloride to liquify the cellulose and thereafter hydrolyzing the cellulose with acid.

9 Claims, No Drawings

QUANTITATIVE HYDROLYSIS OF CELLULOSE TO GLUCOSE USING ZINC CHLORIDE

BACKGROUND OF THE INVENTION

Much research has been conducted in the area of cellulose hydrolysis to produce fermentable sugars, such as glucose therefrom. Cellulose is the most abundant polymer on earth, and is characterized as a straight chain polymer composed of glucose with beta 1,4-linkages. Cellulose may exist in crystalline or amorphous forms. Generally speaking, one can easily hydrolyze amorphous cellulose with dilute acid or enzymes. Crystalline cellulose, on the other hand, is difficult to hydrolize presumably due to a tight physical packing of the cellulose molecules. As a result, degradation of the hydrolysis products is significant as represented by the following scheme:

$$H_2O + \text{cellulose} \xrightarrow{H+} \text{glucose} \xrightarrow[\text{products}]{H+} \text{degradation}$$

Various methods have been touted for decrystallizing cellulose through the use of solvents to precipitate it in an amorphous form. However, there methods all utilize cellulose which is solid, albeit amorphous.

Penque U.S. Pat. No. 4,018,620 describes a method of hydrolyzing cellulose using calcium chloride and dilute acid at a temperature of 100° C. to form a colloid suspension of the cellulose which is the hydrolyzed at a temperature of 120° C. for a period of 30 minutes. Contrary to Penque's findings, and due apparently to an error in the unit and chemistry of Penque's analysis, we have found that the claimed method does provide a complete conversion of cellulose to glucose. According to Penque, 10% (w/v) of newsprint (which contains cellulose and hemicellulose) was hydrolyzed, thereby obtaining a 10% (w/v) reducing sugar solution which is equivalent to 50% of the total reducing sugar.

Because the hemicellulose fraction is very easy to hydrolyze, and since newsprint generally contains at least 15% hemicellulose, one must subtract this value from the yield of glucose from cellulose fraction thereby getting a yield of only 20%. In addition, Penque used Clinitest tablets to quantitate the sugar. These tablets are also reactive to the degraded glucose, (Hydroxymethyl furfural) and do not provide a true reading of reducing sugars. On the other hand, analyzing with "Tes-tape" or glucose analyzer, which is specifically reactive to glucose, would provide a different and more accurate result.

It is thus, desirable to hydrolyze cellulose in a liquid state. Unfortunately, conventional cellulose swelling reagents and cellulose solvents are either too severe for glucose or unable to catalyze the cellulose hydrolysis.

Zinc chloride is knwn as a cellulose swelling reagent, and swells the cellulose at a concentration range from 60 to 80%, with maximum effect at 75% and 65%. The pH of $ZnCl_2$ at this range no concentration is 0 to −2, and thus is able to provide a catalytic function of cellulose hydrolysis. However, under such conditions glucose is also degraded at a faster rate.

It is therefore an object of the present invention to provide a pretreatment of cellulose to hydrolyze it to the liquid state for conversion to glucose.

It is a further object of the present invention to provide a method for the quantitative conversion of cellulose to glucose.

These and other objects of the present invention become more apparent from the discussion which follows.

SUMMARY OF THE INVENTION

In accordance with the present invention, cellulose may be quantitatively hydrolyzed to glucose, without degradation of the glucose to such undesirable byproducts as hydroxymethyl furfural, by pretreatment of the cellulose with concentrated solutions of zinc chloride to liquify the cellulose and thereafter hydrolyze the cellulose with acid.

The process according to the present invention generally comprises the steps of:

(a) forming a mixture of cellulose together with zinc chloride, said zinc chloride being in the form of an aqueous solution containing from about 60 to about 80% (preferably about 65 to 76%) by weight of zinc chloride;

(b) heating the mixture formed in step (a) at a temperature of from about 70° to about 180° C. (preferably from about 100° to about 145° C.) for a period of time sufficient to convert the cellulose to a liquid form;

(c) reducing the concentration of the zinc chloride in the mixture (e.g. to from about about 30 to 50%) without crystallizing the cellulose; and (d) completely hydrolyzing the liquid cellulose to glucose at of pH of 2 or less with acid, whereby the cellulose is quantitatively converted to glucose without degradation.

Reduction of the zinc chloride concetration after liquifying the cellulose is an essential step to avoid glucose degradation. Suitably one may reduce the zinc chloride concentration through the addition of water or dilute acid (e.g., hydrochloric, sulfuric, nitric, phosphoric or acetic acid) to the liquified cellulose/zinc chloride mixture. It is important that the cellulose remain in the liquid state and not be re-crystallized. Thus, one should reduce the zinc chloride concentration to a suitable minimum level without cellulose crystallization.

Generally a range of from about 30 to 50% by weight of the zinc chloride solution, and preferably about 35 to 40% concentration is a suitable reduction level.

Upon removal (or dilution) of $ZnCl_2$ solution, the cellulose will form crystal again. However, we have found that 65% of $ZnCl_2$ solution can partially hydrolyze and dissolve the cellulose at elevated temperatures to partially hydrolyze cellulose to a liquid state. We have also found that partially hydrolyzed cellulose can be dissolved in a 50% (or lower, e.g. 30%) $ZnCl_2$ solution, at this concentration, the degradation of glucose is tremendously reduced. Acid (H+) not only accelerates the cellulose hydrolysis rate, but also stabilizes the glucose at the hydrolysis condition.

The present invention thus provides a process to hydrolyze cellulose in a liquid state at a higher hydrolysis rate than that in a solid or colloid state. This invention provides a process to hydrolyze cellulose with a higher yield due to the decreasing of glucose degradation.

One may initially employ 60 to 80% zinc chloride and acid if desired (e.g. HCl or $H_2SO_4$, at a concentration of from about 0 to 5% w/v) to swell and partially hydrolyze cellulose at temperatures ranging from 70° C. to 180° C. Within a few seconds to several hours the cellulose is dissolved. At this stage, the cellulose solution can then be diluted with water, or more acid and the cellulose remains in solution, but the glucose degradation rate is drastically reduced. Yields in excess of 90% glucose are obtained.

According to the Penque U.S. Pat. No. 4,018,620, mentioned previously, there is described a method using $CaCl_2$ and HCl to hydrolyze cellulose. While the Penque process is similar to part of the present process. Nevertheless, the two processes are distinctly different in concept and mechanism. The process of the present invention utilizes $ZnCl_2$ to prepare cellulose into liquid state. When using the CaCl/HCl method of Penque, cellulose is formed in a colloid state. The present process is designed to hydrolyze cellulose in the liquid state and also to reduce the degradation of glucose by adjusting the cellulose, and $ZnCl_2$ concentration during the course of cellulose hydrolysis. In experiments repeating the $CaCl_2$/HCl method of Penque, but replacing $CaCl_2$ with $ZnCl_2$, one obtains a maximum yield of glucose is 60% in various ranges of acid and $ZnCl_2$ concentration. However, according to the present process, the glucose yield was near unity.

DETAILED DESCRIPTION OF INVENTION

Cellulose hydrolysis proceeds faster in a liquid state than in the solid or colloid state. It is known that many solvents are able to dissolve cellulose, but these solvents either lack the catalytic function or are too severe for the glucose thereby resulting in degradation. The concentration range of $ZnCl_2$ to swell cellulose is between 0 and −2. At this acidity cellulose can be hydrolyzed at an elevated temperature. We found that $ZnCl_2$ solution (preferably ranging from 65 to 76%) could partially hydrolyze cellulose and liquify the cellulose. Unfortunately, at this condition, glucose degradation is too fast, which can reduce the yields of glucose to about 30%. Therefore, it is imperative to accelerate the cellulose hydrolysis and to reduce the glucose degradation in order to obtain a high yield of glucose. In accordance with the present invention hydrolysis is accelerated by the addition of acid or water. Results indicate that $ZnCl_2$ in the presence of acid stabilizes glucose, and also the glucose degradation is drastically reduced by lowering the concentration of the $ZnCl_2$ solutions. We have also found that cellulose can degrade to non-glucose product in the $ZnCl_2$ solution when cellulose is not in liquid state. Fortunately, the liquified cellulose remains in solution after lowering the $ZnCl_2$ concentration.

In forming the initial mixture of cellulose and zinc chloride solution, we have found that the maximum amount of cellulose which may be added to the concentrated zinc chloride solution is about 1 gram of cellulose for each 2 ml of zinc chloride solution.

One of the problems attendant to the process is the separation of $ZnCl_2$ from the partially hydrolyzed cellulose, or glucose, if cellulose is hydrolyzed to glucose completely. Glucose and $ZnCl_2$ are difficult to separate. Several methods can, however, be employed for the separation purposes, including by way of example ion exclusion with an anion exchanger.

The following examples are offered to more fully illustrate the invention, but are not to be construed as limiting the scope thereof.

EXAMPLE 1

One gram of cotton linter is swollen in 5 ml of $ZnCl_2$ (72%—i.e. 72 gms $ZnCl_2$ and 28 gms water) solution which contains 2% HCl (w/v). The cellulose is swollen and partialy hydrolyzed at 98° C. After 10 minutes, the cellulose was dissolved completely. Five ml of 2% HCl was then added to the cellulose solution. After 10 minutes of heating at 98° C., cellulose was hydrolyzed to glucose with a yield of 90%.

EXAMPLE 2

The procedure of Example 1 was repeated using, Avicel instead of cotton linter. The yield of glucose was above 90%.

EXAMPLE 3

According to the procedure of Example 1, lignocellulose from sugercane bargasse was treated. The yield of glucose was 90%.

We have also found that the degradation rate of glucose is affected by temperature, the concentration of $ZnCl_2$, and acid. The rate of glucose degradation can be expressed as:

$$K_{DEG}=2.23\times10^{2}([ZnCl_2]^{4.53}+4.62[H^+]^{0.544})\times e^{-2.185\times104/RT-20.85[H^+]^{0.551}}$$

This means that lower acid, $ZnCl_2$ concentration, and low temperature stabilizes glucose. However the concentration of $ZnCl_2$ that can dissolve cellulose is detrimental to the glucose. Fortunately, the data indicates that the dissolved and partially hydrolyzed cellulose can remain in solution at a lower concentration of $ZnCl_2$ achieved in accordance with the present invention.

The invention having been thus described, it will be appreciated that various departures may be may therefrom within the scope of the claims which follow.

We claim:

1. A process for the quantitative hydrolysis of cellulose to glucose, without degradation of the glucose to hydroxymethtyl furfural, which process comprises the steps of:

(a) forming a mixture of cellulose solids together with zinc chloride, said zinc chloride being in the form of an aqueous solution containing from about 60 to about 80% by weight of zinc chloride;

(b) heating the mixture formed in step (a) at a temperature of from about 70° to about 180° C. for a period of time sufficient to convert the cellulose to a liquid form without appreciable formation of glucose;

(c) reducing the concentration of the zinc chloride in the mixture without crystallizing the cellulose by the addition of water or dilute acid;

(d) completely hydrolyzing the liquid cellulose to glucose at a pH of 2 or less with acid, whereby the cellulose is quantitatively converted to glucose without degradation, and thereafter separating the glucose from the mixture.

2. The process of claim 1 wherein the concentration of zinc chloride in step (a) ranges from about 65 to 76% by weight.

3. The process of claim 1 wherein the concentration of zinc chloride in step (c) is reduced by the addition of water.

4. The process of claim 1 wherein the mixture in step (a) also contains dilute acid.

5. The process of claim 1 or claim 3 wherein the concentration of zinc chloride is reduced to a concentration ranging from about 30 to 50%.

6. The process of claim 1, claim 3 or claim 4 wherein said acid is selected from the group consisting of hydrochloric, sulfuric, nitric phosphoric and acetic acid.

7. A process according to claim 1 wherein the cellulose in step (a) is selected from the group consisting of cotton linter and ligno-cellulose.

8. A process according to claim 1 wherein the cellulose in step (a) is crystalline cellulose.

9. The process of claim 1 wherein the concentration of zinc chloride in step (c) is reduced by the addition dilute acid.

* * * * *